US012389957B2

(12) United States Patent
Ravden

(10) Patent No.: US 12,389,957 B2
(45) **Date of Patent: *Aug. 19, 2025**

(54) UNDERGARMENT FOR WOMEN WITH SLEEVES

(71) Applicant: Tiana Grace Ravden, Marina Del Rey, CA (US)

(72) Inventor: Tiana Grace Ravden, Marina Del Rey, CA (US)

(73) Assignee: Tiana Grace Ravden, Marina Del Rey, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/516,723

(22) Filed: Nov. 21, 2023

(65) Prior Publication Data

US 2024/0148084 A1 May 9, 2024

Related U.S. Application Data

(63) Continuation of application No. 17/547,123, filed on Dec. 9, 2021, now Pat. No. 11,857,000.

(60) Provisional application No. 63/123,382, filed on Dec. 9, 2020.

(51) Int. Cl.
*A41C 3/08* (2006.01)

(52) U.S. Cl.
CPC ..... *A41C 3/08* (2013.01)

(58) Field of Classification Search
CPC ..... A41C 3/08
See application file for complete search history.

(56) References Cited

U.S. PATENT DOCUMENTS

| | | | | |
|---|---|---|---|---|
| 8,650,662 | B2 | 2/2014 | Decker | |
| 9,351,527 | B1 | 5/2016 | Costanza | |
| 11,587,000 | B2 * | 2/2023 | Pinard | H04L 67/306 |
| 2012/0324615 | A1 | 12/2012 | Heimann | |
| 2013/0303049 | A1 | 11/2013 | Jackson et al. | |
| 2020/0022422 | A1 | 1/2020 | Clarke | |

OTHER PUBLICATIONS

US/RO—International Search Report and Written Opinion for related International Application No. PCT/US2021/062477 mailed Feb. 22, 2022; 11 pgs.

* cited by examiner

*Primary Examiner* — Gloria M Hale
(74) *Attorney, Agent, or Firm* — McDermott Will & Emery LLP

(57) ABSTRACT

A women's undergarment item including two cups in a front portion, optionally separated by a center gore, two wings in a back portion, a sleeve attached to one of the wings and to a cup edge via an elastic material, and two straps joining each of the wings to one of the cups, wherein the straps are configured to support an edge of the sleeve that begins on one of the cups and ends in one of the wings, is provided.

14 Claims, 9 Drawing Sheets

UNDERGARMENT FOR WOMEN WITH SLEEVES

CROSS REFERENCE TO RELATED APPLICATIONS

This application is a Continuation of U.S. Non-Provisional patent application Ser. No. 17/547,123, filed on Dec. 9, 2021, now U.S. Pat. No. 11,857,000, and is related to International Patent Application No. PCT/US2021/062477, filed Dec. 8, 2021, each of which claims priority to U.S. Provisional Patent Application No. 63/123,382, filed on Dec. 9, 2020, the entire contents of each are incorporated herein by reference.

BACKGROUND

Field

The present disclosure is related to the field of women's undergarments. More specifically, the following disclosure is related to design and fabrication of comfortable, anatomically consistent brassieres for use by women.

Related Art

Current designs for brassieres and other women's undergarments focus too much, and sometimes solely, on aesthetic or moral principles, putting aside health, comfort, and other ergonomic considerations relevant to the women using the undergarments. There is an ongoing need for a woman's undergarment that, in addition to being aesthetically pleasing, is comfortable, hygienic, and easy to use.

SUMMARY

The present invention relates to a garment comprising (i) a front portion comprising a first cup and a second cup, the first and second cups optionally being separated by a center gore, (ii) a back portion comprising a first wing and a second wing, (iii) a first sleeve attached to the first wing, and (iv) a first strap and a second strap, wherein the first strap is configured to support an edge of the first sleeve, said edge of the first sleeve extending from the first cup to a point located on the first wing to which the first strap attaches.

The present invention also relates to an adjustable garment comprising (i) a front portion comprising a first cup and a second cup, (ii) a back portion comprising a first wing and a second wing, (iii) a first sleeve removably attachable to the first cup and the first wing, wherein the first sleeve comprises a strap and a plurality of hooks configured to secure the first sleeve and the first strap to the first cup and the first wing.

The present invention also relates to an adjustable garment comprising (i) a front portion comprising a first cup and a second cup, (ii) a back portion comprising a first wing and a second wing, (iii) a first sleeve removably attachable to the first cup and the first wing, wherein the first sleeve comprises a first strap, (iv) a second sleeve removably attachable to the second cup and the second wing, wherein the second sleeve comprises a second strap, wherein the first strap is attachable to the first cup and a point on the first wing, and wherein the second strap is attachable to the second cup and a point on the second wing.

Additional features of the present invention will be apparent to persons of ordinary skill in the art in view of the following disclosure, as well as the accompanying drawings and claims.

BRIEF DESCRIPTION OF THE DRAWINGS

The accompanying drawings, which are included to provide further understanding and are incorporated in and constitute a part of this specification, illustrate disclosed, non-limiting embodiments of the present invention. The drawings, together with the description, serve to explain the principles of the disclosed embodiments. In the drawings:

FIG. 3A illustrates an exemplary, non-limiting embodiment of a garment of the present invention in which a sleeve is set to each wing and corresponding cup edge, and each sleeve has bonded fabric on the inside of the sleeve hem, a yoke, and a fully encased stretchline J strap. The embodiment depicted in FIG. 3A has a bottom gore separating the two cups.

FIG. 3B illustrates another exemplary, non-limiting embodiment of a garment of the present invention in which, e.g., hooks are used on each detachable sleeve to attach to a cup and corresponding wing. In the embodiment of FIG. 3B, sleeves are set to inside wings and cup edges with small, low-profile snaps. Slotted elastic may be provided along the top of the wing and underarm for snap placement. The male side of the snaps may be provided on the sleeves and the female side may be provided on the wings and cups, for example.

DETAILED DESCRIPTION

Figure 1A:
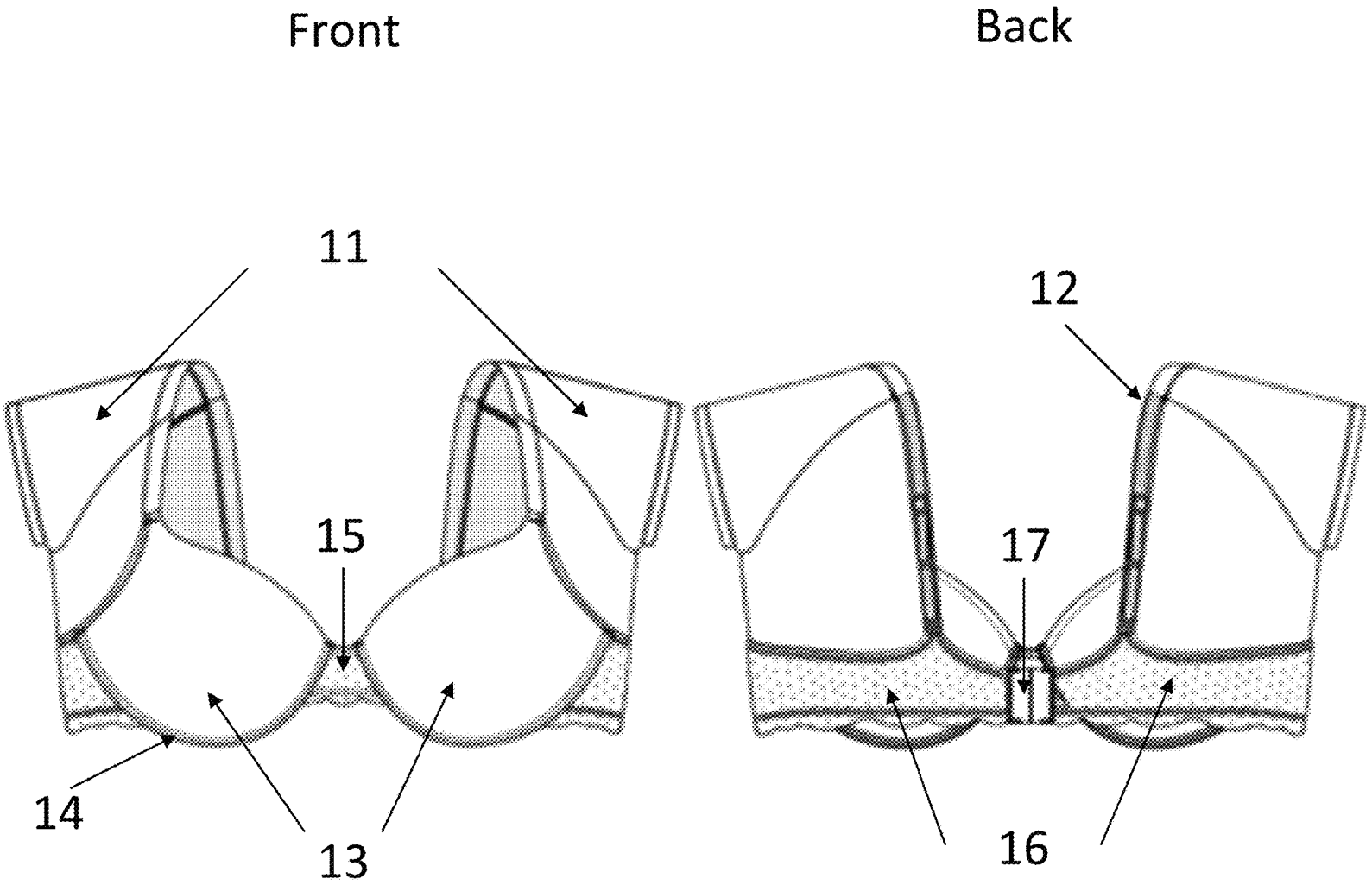
FIG. 1A illustrates front and back views of an exemplary, non-limiting embodiment of a women's brassiere including permanently attached sleeves 11, according to some embodiments. The exemplary, non-limiting embodiment of FIG. 1A comprises straps 12, as well as cups 13 having underwire 14, where the cups are separated by a center gore 15. As shown in the back view in FIG. 1A, the exemplary, non-limiting embodiment also comprises wings 16 which may be fastened together using a hook-and-eye 17 mechanism.

In the following detailed description, numerous specific details are set forth to provide a full understanding of the present disclosure. It will be apparent, however, to one ordinarily skilled in the art, that the embodiments of the present disclosure may be practiced without some of these specific details. In other instances, well-known structures and techniques have not been shown in detail so as not to obscure the disclosure. Embodiments as disclosed herein may include any and all of the features, in any combination.

All definitions, as set forth and used herein, should be understood to control over dictionary definitions, definitions in documents incorporated by reference, and/or ordinary meanings of the defined terms.

All references, patents and patent applications disclosed herein are incorporated by reference with respect to the subject matter for which each is cited, which in some cases may encompass the entirety of the document. All references disclosed herein, including patent references and non-patent references, are hereby incorporated by reference in their entirety as if each was incorporated individually. However, where a patent, patent application, or publication containing express definitions is incorporated by reference, those express definitions should be understood to apply to the incorporated patent, patent application, or publication in which they are found, and not necessarily to the text of this application, in particular the claims of this application, in which instance, the definitions provided herein are meant to supersede.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

The compositions of the present disclosure can comprise, consist essentially of, or consist of, the components disclosed.

As used herein, "optional" or "optionally" means that the subsequently described circumstance may or may not occur, so that the description includes instances where the circumstance occurs and instances where it does not.

As used herein, the term "about" or "approximately" means within an acceptable error range for the particular value as determined by one of ordinary skill in the art, which will depend in part on how the value is measured or determined, i.e., the limitations of the measurement system. For example, "about" can mean within an acceptable standard deviation, per the practice in the art. Alternatively, "about" can mean a range of up to ±20%, preferably up to ±10%, more preferably up to ±5%, and more preferably still up to ±1% of a given value. Where particular values are described in the application and claims, unless otherwise stated, the term "about" is implicit and in this context means within an acceptable error range for the particular value.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein, the term "bartack" means a series of stitches used to reinforce areas of a garment such as a women's undergarment that may be subject to stress or additional wear as a result of repeated or continued use. As the term is used herein, a "bartack" may be sewn by any means (i.e., by hand or machine), and using any suitable type of stitches or stitching, e.g., whip stitches, zigzag stitches and the like.

As used herein, the phrase "at least one of" preceding a series of items, with the terms "and" or "or" to separate any of the items, modifies the list as a whole, rather than each member of the list (e.g., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The word "exemplary" is used herein to mean "serving as an example, instance, or illustration." Any embodiment described herein as "exemplary" is not necessarily to be construed as preferred or advantageous over other embodiments. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No clause element is to be construed under the provisions of 35 U.S.C. § 112, sixth paragraph, unless the element is expressly recited using the phrase "means for" or, in the case of a method clause, the element is recited using the phrase "step for."

Women's clothing, and particularly undergarments, have both an aesthetic and an ergonomic functionality that is challenging to provide simultaneously. Brassieres are an example of a piece of women's undergarment that significantly impacts the exterior look of a person, and also is in direct contact with a delicate part of a woman's anatomy, with potential long-lasting health effects resulting from improper designs.

FIG. 1A illustrates front and back views of a women's brassiere including two cups in a front portion, wherein the cups are separated by a center gore, and two wings in a back portion. The women's brassiere also includes a sleeve attached to one or both of the wings and to a cup edge via an elastic material and two straps joining each of the wings to one of the cups, wherein the straps are configured to support an edge of the sleeve that begins on one of the cups and ends in one of the wings. In some embodiments, the sleeve is permanently attached to the wing and the cup edge. In other embodiments, the sleeve, strap cup and wing are configured such that the sleeve is detachable.

In some embodiments, the cups further include a padding material having a pre-selected resilience. In some embodiments, at least one of the cups and at least one of the sleeves comprise or consist of an anti-microbial fabric. In some embodiments, at least one of the cups and at least one of the sleeves comprise or consist of a moisture resistant fabric. In some embodiments, the one or more sleeves comprise at least two layers of fabric, at least one layer being a moisture barrier. In some embodiments, at least one of the straps is a fully encased stretch line strap. In some embodiments, the straps are secured to the cups with a bartack.

In some embodiments, the women's brassiere further includes a stabilizing tape in a top portion of the center gore and in a bottom portion of the center gore. In some embodiments, the women's brassiere further includes an elastic attached to the wing via a three-step zigzag stitch. In some embodiments, the sleeve is attached to the cup and the wing via multiple low profile snaps disposed along an edge of the cup and an edge of the wing. In some embodiments, the strap loops around at least one hook to have an adjustable length.

In some embodiments, it is desirable that the sleeve fabric matches the same fabric used for the cups. In some embodiments, it is desirable that the sleeve fabric includes hydrophilic wicking to disperse moisture. In some embodiments, armhole sleeve seams may be contoured and shaped to remove excess fabric and avoid wrinkling when in use, or creeping up the arm when moving. In some embodiments, the cups may include a fabric of brushed jersey microfiber.

In some embodiments, the fabric used on sleeves and cup may be the same (e.g., including type, texture, and color). In some embodiments, the fabric used in the cups and sleeves may include about 55% polyamide, 32% cupro, and 13% elastane. In some embodiments, the wings may include about 75% nylon and about 15% spandex. In some embodiments, the fabric includes polygiene treated fabric, anti-microbial fabric, anti-bacterial and moisture barrier fabric. In some embodiments, the fabric may be selected according to feel and look (texture, color). It is desirable that the sleeve fits tightly on the user's shoulder, but not too tight so as to cause the sleeve to fall off the shoulder.

Embodiments disclosed herein may be of any size or dimension to accommodate users of various sizes. Cup sizes may include, for example and without limitation, 32A-DD, 34B-DD, 36B-DD, 38C-DD, and so forth.

In some embodiments, the cups include a lightly molded demi cup underwire inserted in a channel, and secured with bartacks at the end to relieve stress and prevent wear and tear.

In other embodiments, an underwire is not provided.

Some embodiments include a cup liner with wicking finish to absorb moisture in the pad.

The cup optionally includes a padding material to provide strength, support, and protection to the breast. The padding material may include a stretchable foam having a pre-selected resiliency to provide a desirable strength without stressing the breast out of a comfort zone.

In some embodiments, the cups may be formed without underwire.

Figure 1B:
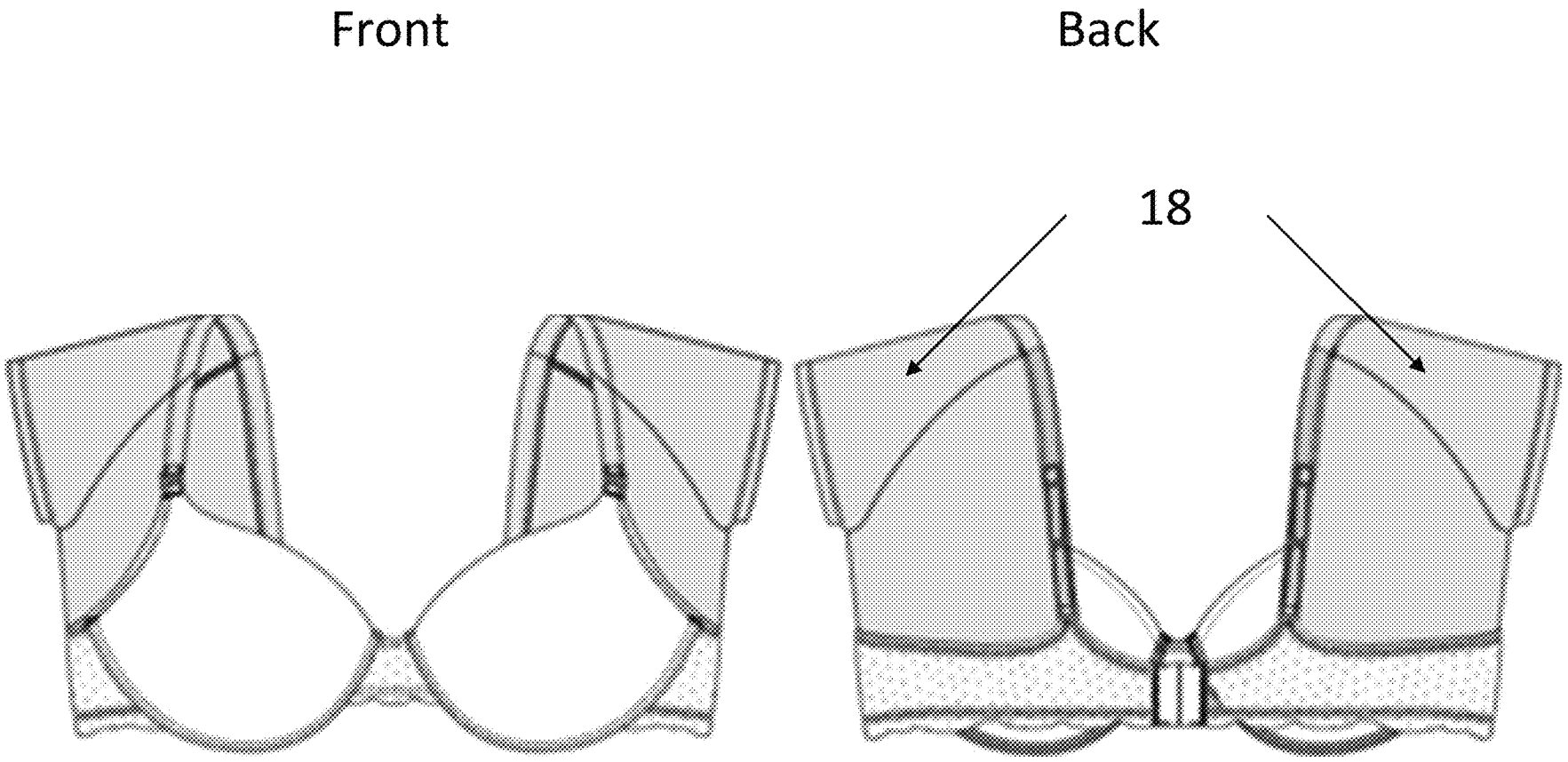
FIG. 1B illustrates front and back views of an exemplary, non-limiting embodiment of a women's brassiere including detachable sleeves, according to some embodiments. The exemplary, non-limiting embodiment of FIG. 1B has detachable sleeves 18.

FIG. 1B illustrates front and back views of an exemplary, non-limiting embodiment of a women's brassiere including detachable sleeves, according to some embodiments. In some embodiments, a marrow stitch or high SPI over-seam is used to finish the lower edge of the sleeve. In some embodiments, the detachable sleeve includes snaps on the inside of the wing. The snaps may be disposed therein by inserting woven tabs between an elastic and the wing fabric. Accordingly, male posts on the sleeve side are aligned to the snaps on the wing.

In some embodiments, a front strap attachment (e.g., to either one of the cups) includes a '9' hook, and the strap exits a tunnel formed on the sleeve edge through a buttonhole and is secured to the sleeve with a bartack. Some embodiments include loops to the back sleeve to permanently attach the sleeve to the center of the '9' hook. In some embodiments, the body fabric in the sleeve includes a stretchable hydrophilic wicking material, resistant to pilling.

Figure 2A:
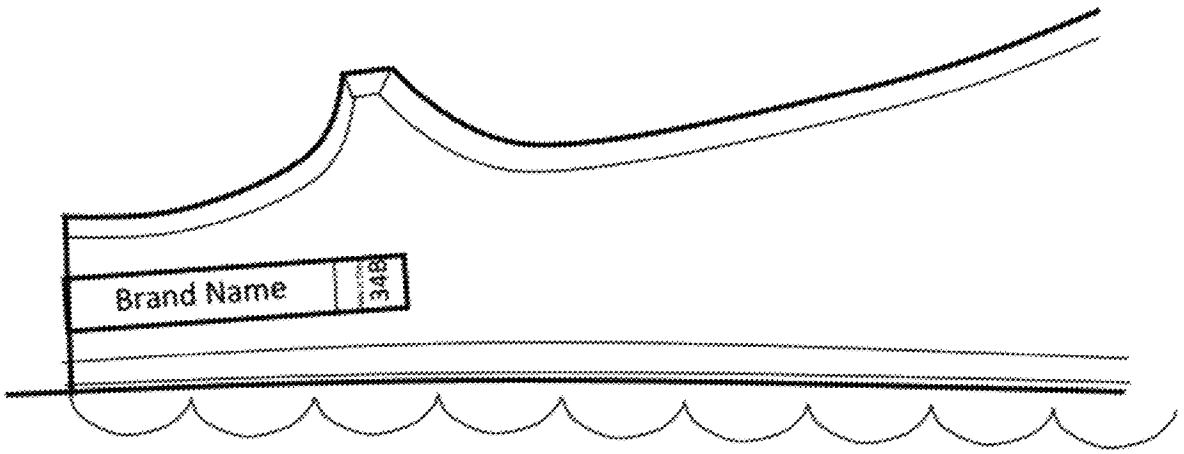
FIG. 2A illustrates an exemplary label placement on a side wing of a women's brassiere, according to some embodiments. In the exemplary, non-limiting embodiment of FIG. 2A, the label is centered at the hook-and-eye mechanism on the wearer's left side wing.

FIG. 2A illustrates an exemplary, non-limiting embodiment of a label placement on a side wing of a women's brassiere, according to some embodiments. The label is centered at the Hook & Eye on wearer's left side wing. In some embodiments, the label width may be approximately fourteen (14) mm, and the label length may be approximately fifty four (54) mm.

Figure 2B:
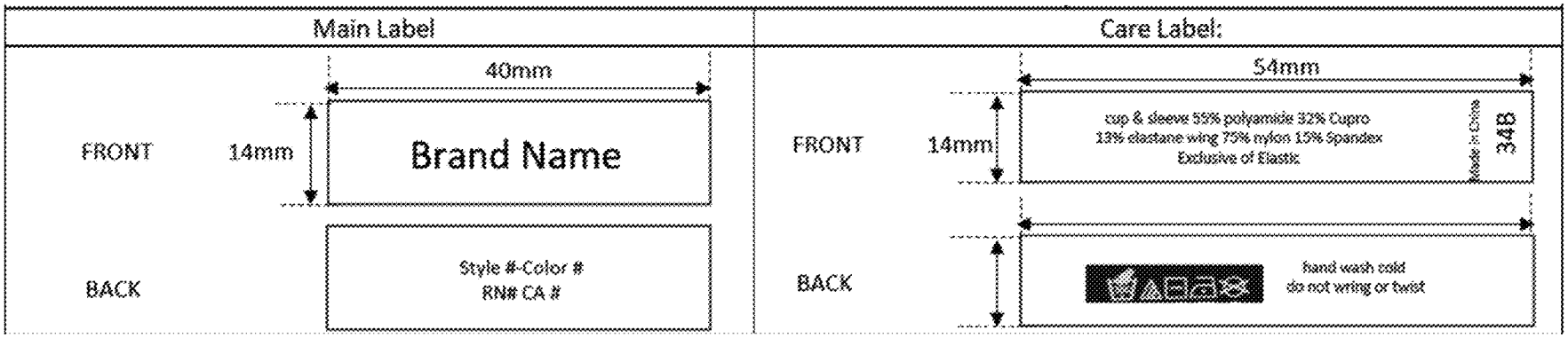
FIG. 2B illustrates exemplary features for display in a label for a women's brassiere, according to some embodiments.

FIG. 2B illustrates exemplary, non-limiting features for display in a label for a women's brassiere, according to some embodiments. Some of the details may include a main label and a care label. The main label may include a brand name and other information such as style, number, color code, and other identification information, and a care label. The care label may include washing/drying/storage recommendations.

Figure 3A:
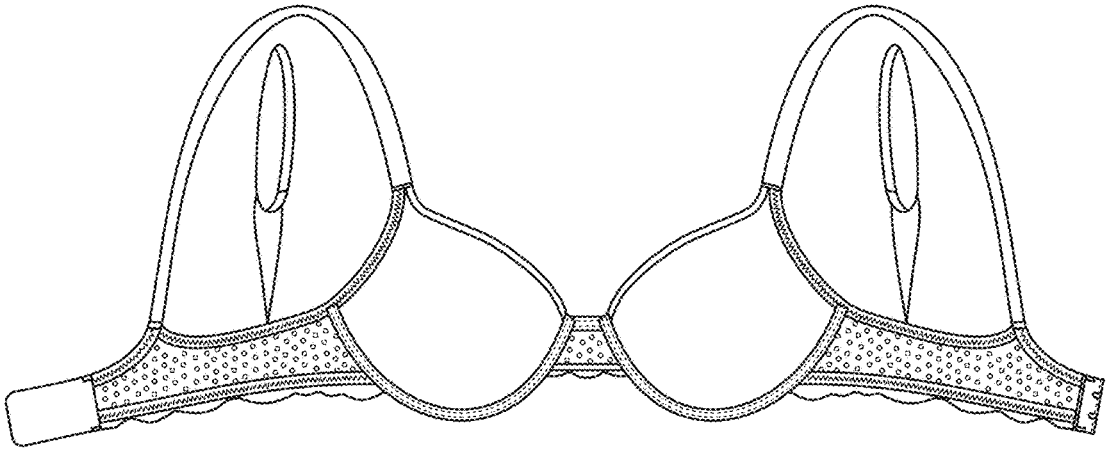
FIGS. 3A and 3B illustrate an exemplary, non-limiting embodiment of an interior view of a women's brassiere, according to some embodiments.

FIG. 3A illustrates an exemplary, non-limiting embodiment of an interior view of a women's brassiere, according to some embodiments. In some embodiments, the women's brassiere includes a yoke forming an aperture for the sleeve.

Figure 3B:
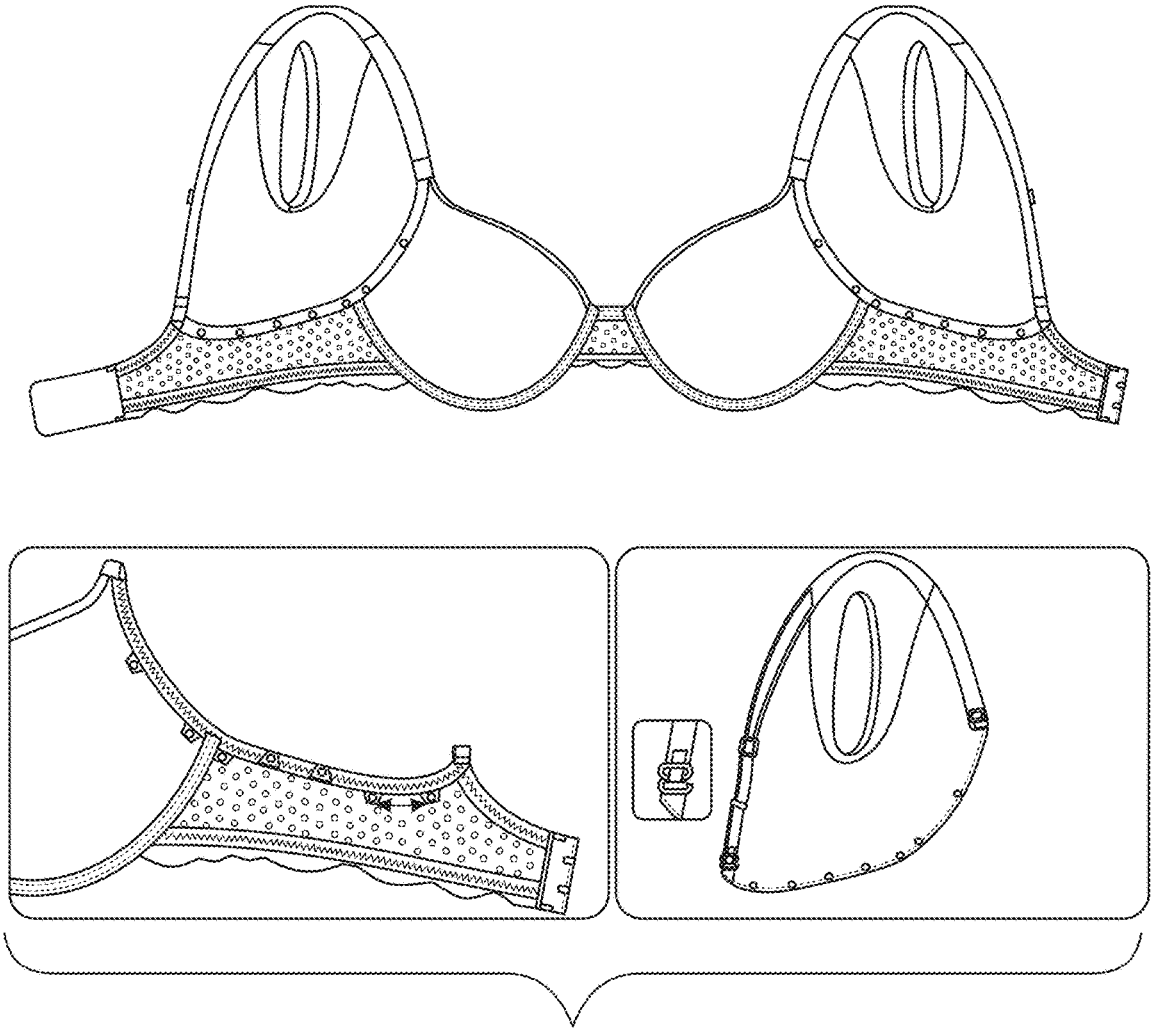

FIG. 3B illustrates an exemplary, non-limiting embodiment of an interior view of a women's brassiere including detachable sleeves, according to some embodiments. Accordingly, sleeves are set to the inside portion of the wing and cup edge via small, low profile snaps. In some embodiments, the snaps are included on the inside of the wing between an elastic band and the brassiere. When in use (snapped to the sleeve), the tabs are folded up to expose the female snap face. In some embodiments, at least one snap is centered along the cup edge, and the snaps are disposed as close as possible to the edge of the wire on each side (left and right wings). The male side of the snaps may be disposed on the sleeves.

In some embodiments, the straps are disposed inside a tunnel on the edge of the sleeve. The tunnel may have a buttonhole on each end to allow the end of the strap to pass through and be secured to the sleeve via a bartack, or a woven tape at the center of a hook.

Figure 4:
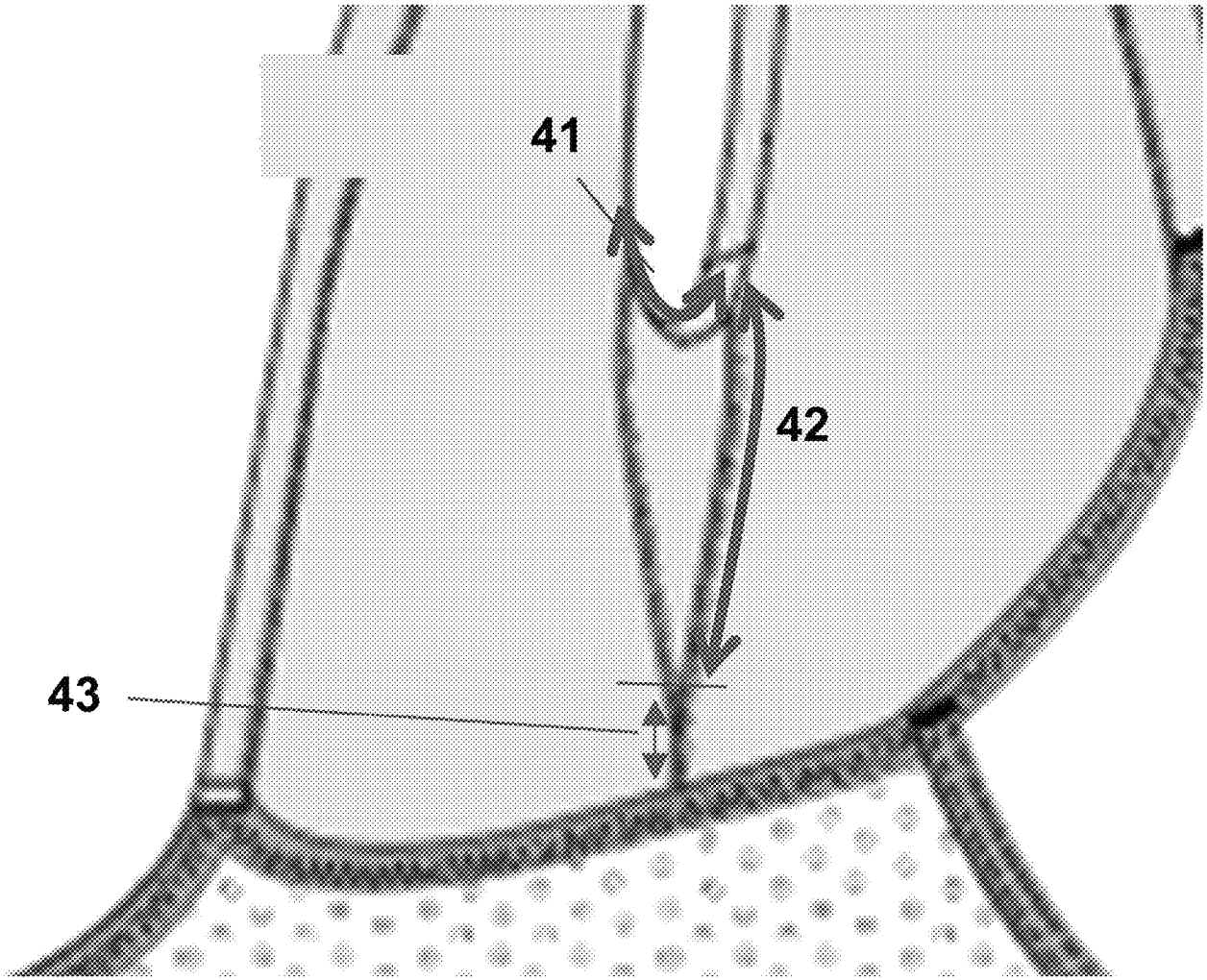
FIG. 4 illustrates an exemplary, non-limiting embodiment of a yoke forming a sleeve in a women's brassiere, according to some embodiments. The exemplary, non-limiting embodiment of FIG. 4 comprises a yoke opening 41 at the armhole (e.g., two inches in length along the depicted curvature in a non-limiting embodiment) and a yoke length 42 (e.g., 4 and ⅛inches in length along the depicted curvature in a non-limiting embodiment). The exemplary, non-limiting embodiment of FIG. 4 further comprises a stop yoke fabric 43 from the top wing edge (e.g., a stop yoke fabric length of ¼inch in a non-limiting embodiment).

FIG. 4 illustrates an exemplary, non-limiting embodiment of a yoke forming a sleeve in a women's brassiere, according to some embodiments. The yoke forms an aperture for the sleeve, wherein the yoke includes two layers of fabric including at least one moisture barrier. In some embodiments, the yoke fabric includes an anti-microbial layer. In some embodiments, the yoke fabric may include a moisture absorbing fabric to desirably absorb moisture from the skin and disperse onto the sleeve fabric. In some embodiments, the yoke may include a gusset to add breadth and reduce stress to the yoke. In some embodiments, the yoke may include two layers: an inner wicking fabric layer, and an outer sleeve fabric layer. In some embodiments, the yoke may include three layers, having a moisture-repelling layer disposed between the inner wicking layer and the outer sleeve fabric layer. In some embodiments, a fabric that repels moisture is desirably disposed on the inner most layer of the yoke. In some embodiments, it is desirable to include a lightweight moisture barrier fabric for more comfortable use.

In some embodiments, the gusset seams have a contour shaped to remove wrinkling on the armhole. The yoke seam lines desirably cover the armpit area. In some embodiments, front and back seams of the yoke may be "bagged out."

Figure 5:
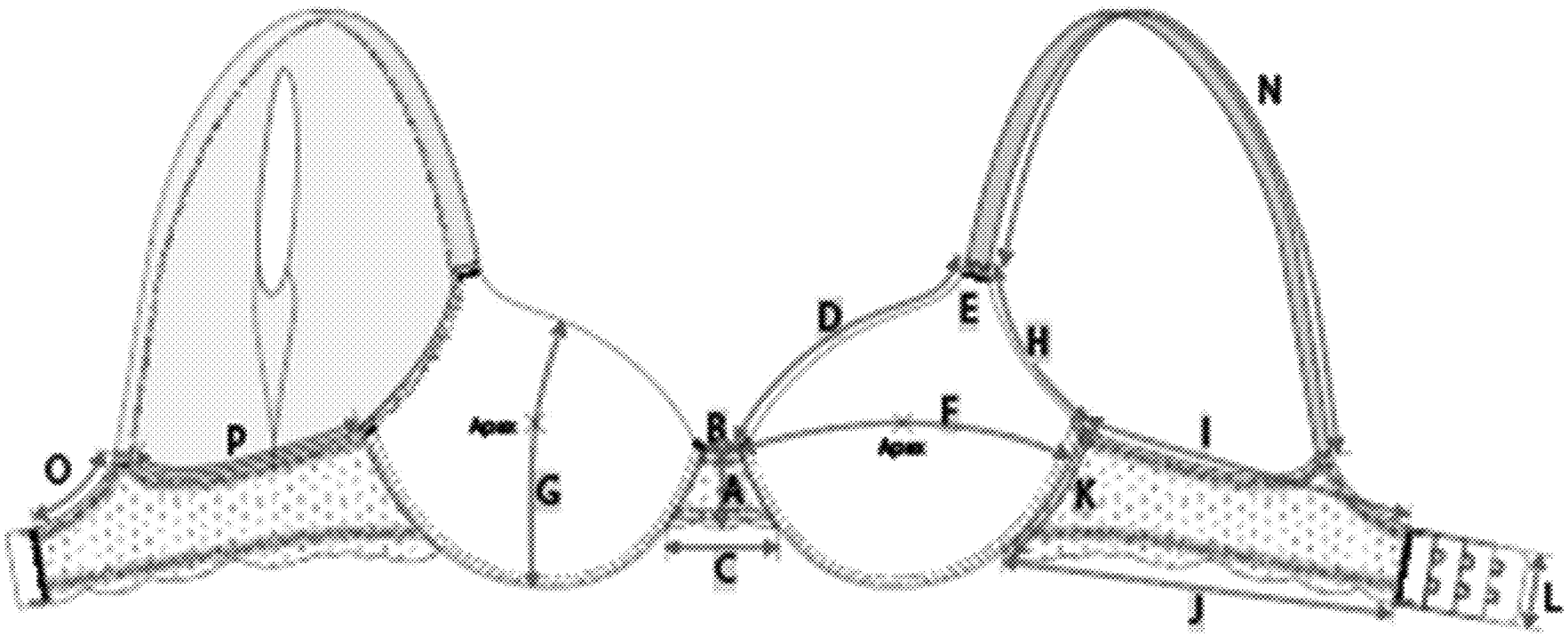
FIG. 5 illustrates an exemplary, non-limiting embodiment of a front view of different parts and dimensions in a women's brassiere, according to some embodiments.

FIG. 5 illustrates an exemplary, non-limiting embodiment of a front view of different parts and dimensions in a women's brassiere, according to some embodiments. In FIG. 5, the left side is shown without the sleeve attached, for clarity. The specific dimensions discussed below are exemplary only, and not limiting of dimensions and ranges to be used in embodiments consistent with the present disclosure.

A gore height to the peak of scallop, A, may have a base size of about 1¾ inches, about 1½ inches, about 1 13/16 inches, about 1 7/16 inches, about 2 inches, about 2 1/16 inches, and a tolerance of about ⅛ inches. More generally, the height to peak of scallop, A, may measure between one (1) to two (2) inches, according to embodiments consistent with this disclosure.

A gore width at the top edge, B, may have a base size of about ⅜ inches, about ¼ inches, about 3/16 inches, about 5/16 inches, and a tolerance of about ⅛ inches. More generally, gore width, B, may measure between one quarter (¼) up to one half (½) inches, or more, according to embodiments consistent with this disclosure.

A gore width, C, at the bottom edge may have a base size of about 2¼ inches, about 2 3/16 inches, about 2½ inches, about 2⅝ inches (e.g., 34 DD cup size), about 2 5/16 inches, about 2⅞ inches (e.g., 34DD cup size), or about 3 inches (e.g., 34DD cup size), and a tolerance of about ⅛ inches. In some embodiments, elongating this dimension provides a rotation to the cup, when desired. In certain embodiments, gore width, C, may range from about two (2.0) to about three (3.0) inches, according to embodiments consistent with the present disclosure.

A neckline-follow having a neckline shape, D, that ends at the front strap platform edge may have a base size of about 7¾ inches (e.g., 34DD cup size), about 7⅛ inches (e.g., 34DD cup size), about 7⅓ inches (e.g., 34DD cup size), about 7 1/16 inches (e.g., 34DD cup size), about 7 5/16 inches (e.g., 34DD cup size), about 7 1/16 inches (e.g., 34DD cup size), about 6¼ inches, about 6½ inches, about 6¾ inches, about 6⅔ inches, about 6⅝ inches, and a tolerance of about ¼ inches. In certain embodiments, the neckline-follow may measure anywhere between about six (6) to about eight (8) inches, according to embodiments consistent with the present disclosure.

A strap platform, E, may have a base size of about ½ inches (e.g., 34DD cup size), about ⅜ inches, about 7/16 inches, about 9/16 inches (e.g., 34DD cup size), and a tolerance of about 1/16 inches. In certain embodiments, strap platform, E, may measure anywhere between less than about one half (½) to more than about one half (½) inches, according to embodiments consistent with the present disclosure.

A cup width across apex, F, may have a base size of about 7⅝ inches, about 7 15/16 inches, about 8 inches, about 9¼ inches (e.g., 34DD cup size), about 9¾ inches (e.g., 34DD cup size), about 9⅞ inches (e.g., 34DD cup size), about 10 inches (e.g., 34DD cup size), and a tolerance of about ⅛ inches. In certain embodiments, cup width, F, may measure anywhere between about seven (7) to about ten (10) inches or more, according to embodiments consistent with the present disclosure.

A cup height across apex, G, may have a base size of about 7½ inches (e.g., 34DD cup size), about 7⅜ inches (e.g., 34DD cup size), 6⅛ inches (e.g., 34DD cup size), about 5 inches, about 5⅜ inches, about 5 5/16 inches, about 5 7/16 inches, and a tolerance of about ⅛ inches. In certain embodiments, cup height, G, may measure anywhere between five (5) to eight (8) inches, according to embodiments consistent with the present disclosure.

A cup armhole edge, H, to strap the platform to the wing via a join seam may have abase size of about 4⅞ inches (e.g., 34DD cup size), about 4¾ inches (e.g., 34DD cup size), about 4 15/16 inches (e.g., 34DD cup size), about 3⅛ inches, about 3 3/16 inches, about 3 inches, and a tolerance of about ⅛ inches. In certain embodiments, cup armhole edge, H, may measure anywhere between about three (3) to about five (5) inches, according to embodiments consistent with the present disclosure.

A hookup length, I, measured straight from wing insert to wing insert (excluding hook and eye), is measured with elastic relaxed. This may have a base size of 9 inches (e.g., 34DD cup size), about 9⅛ inches (e.g., 34DD cup size), about 8 inches, about 8 1/16 inches, about 8¼ inches, about 8¾ inches, about 8⅞ inches (e.g., 34DD cup size), about 7¾ inches, about 7⅞ inches, about 7½ inches, about 7⅝ inches, and a tolerance of about ⅛ inches. In certain embodiments, hookup length, I, may measure anywhere between about seven (7) to about ten (10) inches, according to embodiments consistent with the present disclosure.

A bottom wing-front, J, joining the cup to the hook and eye (excluding the hook and eye) is measured with elastic relaxed and may have a base size of about 7 15/16 inches, about 7¾ inches, about 8 inches, about 8¼ inches, about 8⅛ inches, about 8⅜ inches (34DD cup size), about 8⅝ inches (e.g., 34DD cup size), about 8¾ inches (e.g., 34DD cup size), and a tolerance of about ¼ inches. In some embodiments, elongating this dimension allows a rotation of the cup pad on the body, if desired. In certain embodiments, bottom wing front, J, may measure anywhere between about seven (7) and about nine (9) inches, according to embodiments consistent with this disclosure.

A wing height at join, K, is measured along cup join seam curve, and may have a base size of about 3½ inches, about 3¾ inches, about 3 11/16 inches, about 3⅞ inches, about 4 inches, 4 3/16 inches, 4 about ⅛ inches, about 4½ inches (e.g., 34DD cup size), about 5 inches (34DD cup size), about 5⅛ inches (34DD cup size), about 5⅜ inches (e.g., 34DD cup size), about 5 5/16 inches (e.g., 34DD cup size), about 5⅝ inches (e.g., 34DD cup size), and a tolerance of about ¼ inches. In certain embodiments, wing height at join, K, may measure anywhere between about three (3) to about six (6) inches, according to embodiments consistent with this disclosure.

A band height, L, measures the width of the hook and eye, having a base size of about 1⅛ inches, about 1½ inches, about 1 3/16 inches, about 1⅜ inches (34DD cup size), about 1 7/16 inches (e.g., 34DD cup size), and a tolerance of about ⅛ inches. In certain embodiments, band height, L, may measure anywhere between about one (1) to about two (2) inches, according to embodiments consistent with this disclosure.

An elastic strap length, N, measured from the joint to the cup to the joint with the wing may have a base size of about 12¼ inches (e.g., 34DD cup size), about 12½ inches (e.g., 34DD cup size), about 12⅝ inches (e.g., 34DD cup size), about 12⅜ inches (e.g., 34DD cup size), about 13⅝ inches, about 13½ inches, about 13 9/16 inches, about 14 inches, about 14⅞ inches, about 15 inches, and a tolerance of about ¼ inches. In some embodiments, the strap length is adjustable by the user to ensure a close and secure, yet comfortable fit over the user's shoulder. In certain embodiments, elastic strap length, N, may measure anywhere between about twelve (12) and about fifteen (15) inches, according to embodiments consistent with the present disclosure.

A top wing, O, forms a bust seam to hook and eye join (excluding the hook and eye) and has a base size of about 3 inches, about 2½ inches, about 2⅛ inches, about 2¼ inches, about 2 9/16 inches, about 2⅞ inches (e.g., 34DD cup size), about 2¾ inches, and a tolerance of about ¼ inches. In certain embodiments, top wing, O, may measure anywhere between about two (2) to about three (3) inches, according to embodiments consistent with the present disclosure.

A wing armhole edge, P, is measured along a hookup edge to platform edge, having a base size of about 6 inches, about 6¼ inches, about 6½ inches, about 5½ inches, about 5⅜ inches, about 5 7/16 inches, about 4⅞ inches, 4½ inches, and a tolerance of about ⅛ inches. In certain embodiments, the wing armhole edge, P, may measure anywhere between about four (4) to about seven (7) inches, according to embodiments consistent with the present disclosure.

Figure 6:
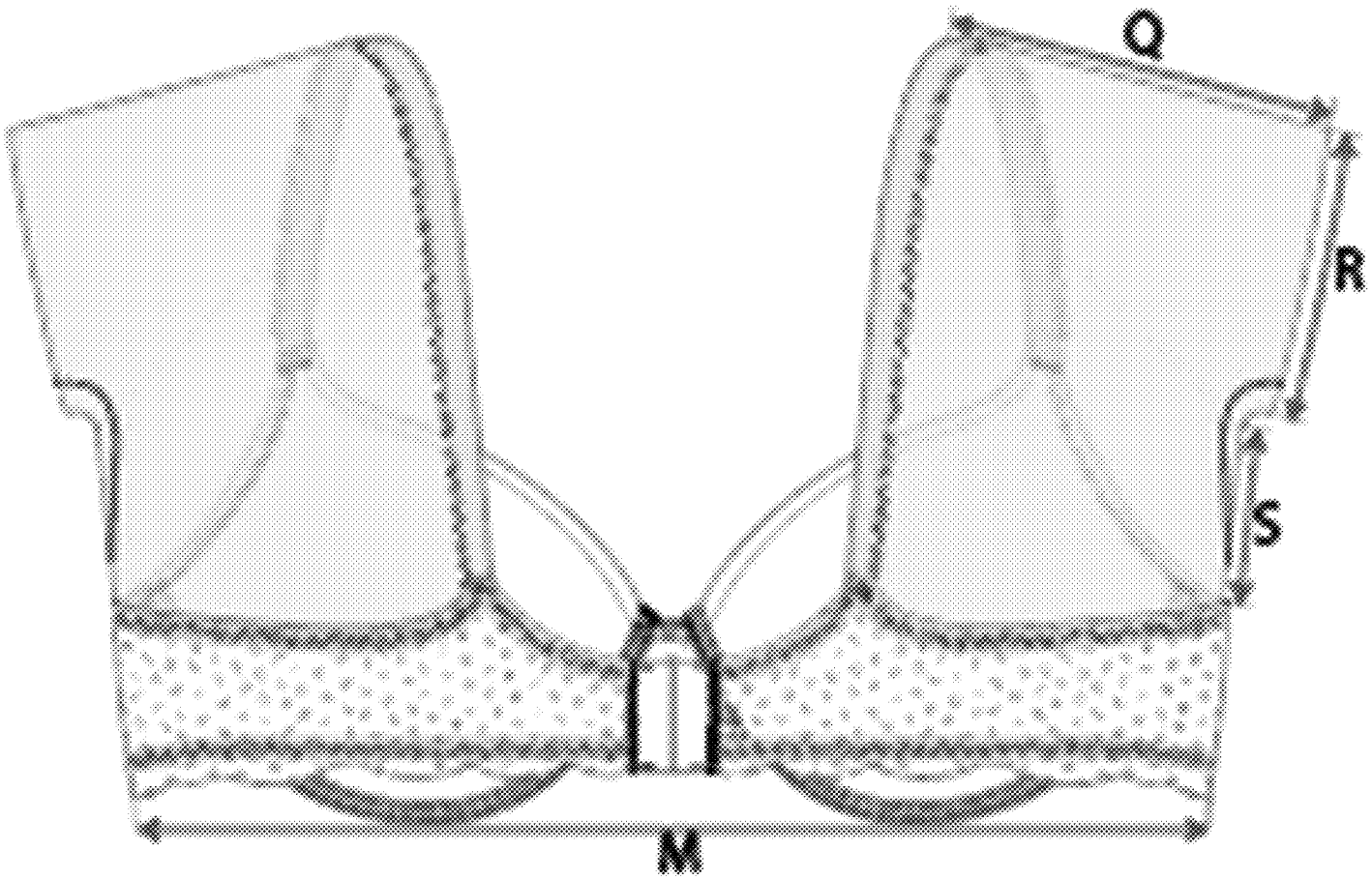
FIG. 6 illustrates an exemplary, non-limiting embodiment of a back view of different parts and dimensions in a women's brassiere, according to some embodiments.
Figure 7:
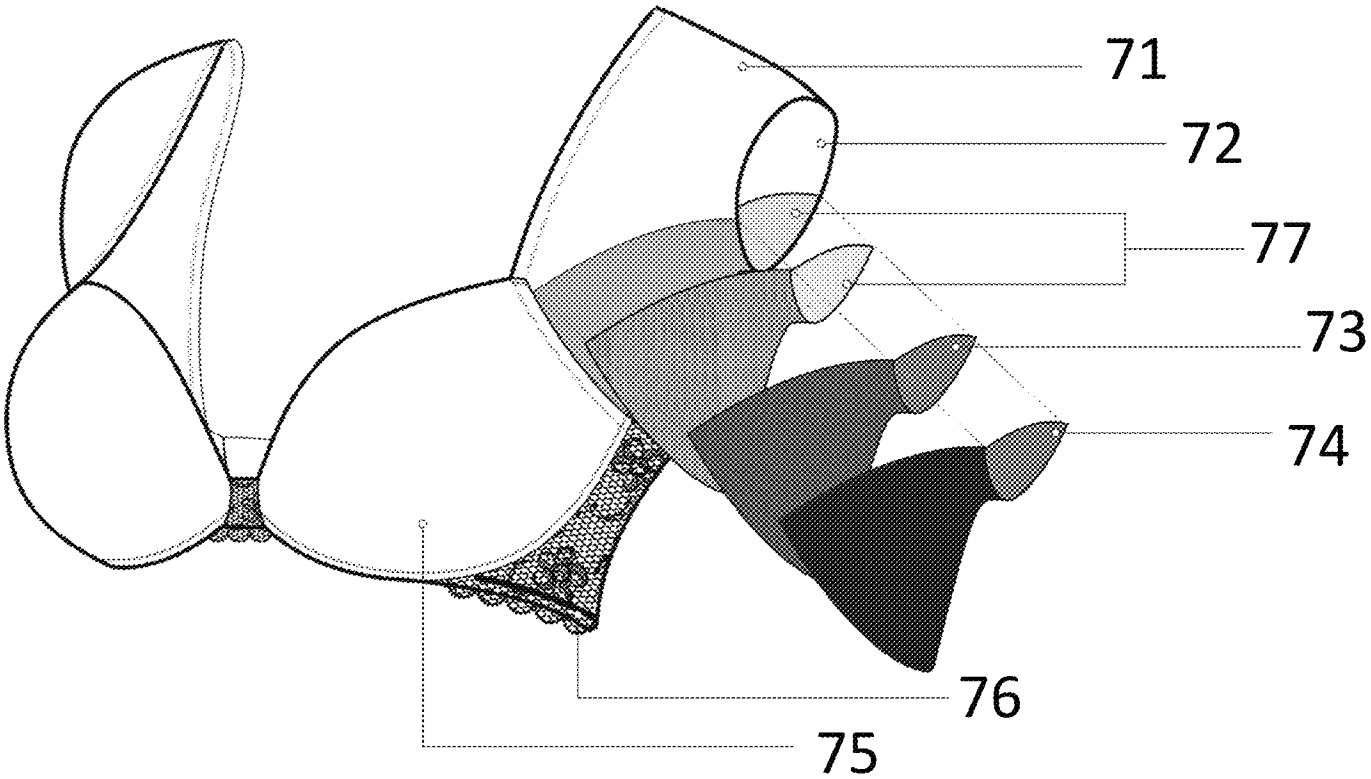
FIG. 7 depicts an exemplary, non-limiting embodiment of a women's brassiere including, on either side of the brassiere, a stretch retention cap sleeve 71, a seamless cap sleeve 72, at least one moisture barrier 73, and at least one outer body water-repellent finish 74. The brassiere may optionally include a pair of molded cups 75 and/or aesthetic designs 76 (e.g., unique lace detailing). In certain embodiments, the stretch retention cap sleeve 71 and/or the seamless cap sleeve 72 and/or the moisture barrier 73 and/or the outer body water-repellent finish 74 comprises an antibacterial/antimicrobial fabric 77 (e.g., yarn) with anti-odor functions or properties.

FIG. 6 illustrates a back view of different parts and dimensions in a women's brassiere, according to some embodiments.

A bottom band length, M, includes a total width on the bottom side of the brassiere, including the hook and eye, and may have a base size of about 24 inches, about 24¾ inches, about 25 inches, about 25⅜ inches, about 25⅛ inches, about 25½ inches, and a tolerance of about ½ inches. In certain embodiments, bottom band length, M, may measure anywhere between about twenty-four (24) to about twenty-six (26) inches, according to embodiments consistent with the present disclosure.

A sleeve length, Q, is measured at the center of the sleeve with a base size of about 4½ inches, about 4⅞ inches, about 5⅜ inches, about 5¼ inches, about 5¾ inches, about 5⅞ inches, about 6⅜ inches (e.g., 34DD cup size), about 7 inches, and a tolerance of about ¼ inches. Sleeve length Q is adjusted for a close fit, and to desirably avoid the sleeve falling off from the shoulder. In certain embodiments, sleeve length, Q, may measure anywhere between about four (4) to about seven (7) inches, according to embodiments consistent with the present disclosure.

A sleeve opening, R, is measured on half at opening, with a base size of about 4¾ inches, about 4⅜ inches (e.g., 34DD cup size), about 4⅞ inches (e.g., 34DD cup size), about 5⅛ inches (e.g., 34DD cup size), about 5¾ inches, about 5⅞ inches, and a tolerance of about ¼ inches. In certain embodiments, sleeve opening, R, may measure anywhere between about four (4) to about six (6) inches, according to embodiments consistent with the present disclosure.

A side length of sleeve body, S, is measured at a center of the pattern piece, or the narrowest point-edge of brassiere-to-sleeve opening, with a base size of about 3 inches, about 4¼ inches, about 4¾ inches, about 5¾ inches (e.g., 34DD cup size), 6⅛ inches (e.g., 34DD cup size), about 6⅜ inches (e.g., 34DD cup size), and a tolerance of about ⅛ inches. In certain embodiments, sleeve body, S, may measure anywhere between about three (3) to about seven (7) inches, according to embodiments consistent with the present disclosure.

In certain embodiments, a garment described herein comprises (i) a front portion comprising a first cup and a second cup, (ii) a back portion comprising a first wing and a second wing, (iii) a first sleeve attached to the first wing, and (iv) a first strap and a second strap.

In certain embodiments, the first strap is configured to support an edge of the first sleeve, said edge of the first sleeve extending from the first cup to a point located on the first wing to which the first strap attaches.

In other embodiments, the garment may further comprise a second sleeve. In certain embodiments, the second strap is configured to support an edge of the second sleeve, said edge of the second sleeve extending from the second cup to a point located on the second wing to which the second strap attaches.

In certain embodiments, the first and second cups are separated by a center gore. In other embodiments, the first and second cups are not separated by a center gore.

In certain embodiments, an adjustably configurable garment described herein comprises (i) a front portion comprising a first cup and a second cup, (ii) a back portion comprising a first wing and a second wing, (iii) a first sleeve removably attachable to the first cup and the first wing. In certain embodiments, the first sleeve comprises a strap and a plurality of hooks configured to secure the first sleeve and the first strap to the first cup and the first wing.

In certain embodiments, the garment further comprises a second sleeve removably attachable to the second cup and the second wing. In certain embodiments, the second strap is configured to support an edge of the second sleeve, said edge of the second sleeve extending from the second cup to a point located on the second wing to which the second strap attaches.

In certain embodiments, the garment comprises a second strap, wherein the garment does not comprise a second sleeve.

In certain embodiments, the edge of the first sleeve comprises a plurality of hooks, snaps or clasps and the first wing comprises a plurality of corresponding hooks, snaps or clasps.

In certain embodiments, the second strap is removably attachable to the second cup and the second wing.

In certain embodiments, the first strap is detachable from the first sleeve.

In certain embodiments, the first sleeve and first strap are contained in a single portion.

In certain embodiments, the second sleeve and second strap are contained in a single portion.

In certain embodiments, a garment described herein is adjustable and comprises (i) a front portion comprising a first cup and a second cup, (ii) a back portion comprising a first wing and a second wing, (iii) a first strap, (iv) a second strap, (v) a first sleeve removably attachable to the first cup and the first wing, and (vi) a second sleeve removably attachable to the second cup and the second wing. In certain embodiments, the first sleeve attaches to a point on the first cup and a point on the first wing, and wherein the second sleeve attaches to a point on the second cup and a point on the second wing.

The subject technology is illustrated, for example, according to various aspects described below. Various examples of aspects of the subject technology are described as numbered clauses (clause 1, 2, etc.) for convenience. These are provided as examples, and do not limit the subject technology.

Clause 1: A women's undergarment item includes two cups in a front portion, separated by a center gore, two wings in a back portion, a sleeve attached to one of the wings and to a cup edge via an elastic material, and two straps joining each of the wings to one of the cups, wherein the straps are configured to support an edge of the sleeve that begins on one of the cups and ends in one of the wings.

Embodiments consistent with the present disclosure may include the women's undergarment item of clause 1, combined with any one or more of the following elements.

Element 1, wherein the cups further include a padding material having a pre-selected resilience. Element 2, wherein at least one of the cups and the sleeve include an anti-microbial fabric. Element 3, wherein at least one of the cups and the sleeve include a moisture resistant fabric. Element 4, further including a yoke forming an aperture for the sleeve. Element 5, wherein the sleeve includes two layers of fabric, including at least one moisture barrier. Element 6, further including a yoke forming an aperture for the sleeve, wherein the yoke includes two layers of fabric including at least one moisture barrier. Element 7, further including a yoke forming an aperture for the sleeve, wherein the yoke includes an anti-microbial layer. Element 8, wherein at least one of the straps is a fully encased stretch line strap. Element 9, wherein the straps are secured to the cups with a bartack. Element 10, further includes a stabilizing tape in a top portion of the center gore and in a bottom portion of the center gore. Element 11, further including an elastic attached to the wing via a three-step zigzag stitch. Element 12, wherein the sleeve is attached to the cup and the wing via multiple low profile snaps disposed along an edge of the cup and an edge of the wing. Element 13, wherein the strap loops around at least one hook to have an adjustable length.

In one aspect, a method may be an operation, an instruction, or a function and vice versa. In one aspect, a clause may be amended to include some or all of the words (e.g., instructions, operations, functions, or components) recited in other one or more clauses, one or more words, one or more sentences, one or more phrases, one or more paragraphs, and/or one or more clauses.

While this specification contains many specifics, these should not be construed as limitations on the scope of what may be described, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially described as such, one or more features from a described combination can in some cases be excised from the combination, and the described combination may be directed to a subcombination or variation of a subcombination.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the clauses. In addition, in the detailed description, it can be seen that the description provides illustrative examples and the various features are grouped together in various implementations for the purpose of streamlining the disclosure. The method of disclosure is not to be interpreted as reflecting an intention that the described subject matter requires more features than are expressly recited in each clause. Rather, as the clauses reflect, inventive subject matter lies in less than all features of a single disclosed configuration or operation. The clauses are hereby incorporated into the detailed description, with each clause standing on its own as a separately described subject matter.

The clauses are not intended to be limited to the aspects described herein, but are to be accorded the full scope consistent with the language clauses and to encompass all legal equivalents. Notwithstanding, none of the clauses are intended to embrace subject matter that fails to satisfy the requirements of the applicable patent law, nor should they be interpreted in such a way.

All of the features disclosed in this specification may be combined in any combination. Each feature disclosed in this specification may be replaced by an alternative feature serving the same, equivalent, or similar purpose. Thus, unless expressly stated otherwise, each feature disclosed is only an example of a generic series of equivalent or similar features.

From the above description, one skilled in the art can readily ascertain the essential characteristics of the present invention, and can make various changes and modifications of the invention to adapt it to various usages and conditions. Thus, other embodiments are also within the scope of the invention and claims.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed:

1. A garment comprising:

(i) a front portion comprising a first cup and a second cup, (ii) a back portion comprising a first wing and a second wing, (iii) a first sleeve attached to the first wing, and (iv) a first strap and a second strap, wherein the first strap supports an edge of the first sleeve, said edge of the first sleeve extending from the first cup to a point located on the first wing to which the first strap attaches, wherein the first sleeve comprises bonded fabric extending from said first edge of the first sleeve to form a yoke comprising an aperture and a second edge, and wherein the first sleeve comprises a moisture barrier and/or a water-repellent finish.

2. The garment of claim 1, further comprising a second sleeve, wherein the second strap supports an edge of the second sleeve, said edge of the second sleeve extending from the second cup to a point located on the second wing to which the second strap attaches.

3. The garment of claim 1, wherein the first and second cups are separated by a center gore.

4. The garment of claim 1, wherein the first and second cups are not separated by a center gore.

5. The garment of claim 1, wherein the first sleeve and first strap are contained in a single portion.

6. The garment of claim 2, wherein the second sleeve and second strap are contained in a single portion.

7. The garment of claim 2, wherein the second sleeve comprises a moisture barrier and/or a water-repellent finish.

8. The garment of claim 7, wherein the first sleeve and the second sleeve each comprise a moisture barrier.

9. The garment of claim 7, wherein the first sleeve and the second sleeve each comprise a water-repellent finish.

10. The garment of claim 7, wherein the first sleeve and the second sleeve each comprise both a moisture barrier and a water-repellent finish.

11. A garment comprising:

(i) a front portion comprising a first cup and a second cup, (ii) a back portion comprising a first wing and a second wing, (iii) a first strap, (iv) a second strap, (v) a first sleeve supported by an edge of the first strap, said edge of the first sleeve extending from the first cup to a point located on the first wing to which the first strap attaches, and (vi) a second sleeve supported by an edge of the second strap, said edge of the second sleeve extending from the second cup to a point located on the second wing to which the second strap attaches, wherein the first sleeve comprises bonded fabric extending from said first edge of the first sleeve to form a yoke comprising an aperture and a second edge, and wherein the first sleeve comprises a moisture barrier and/or a water-repellent finish.

12. The garment of claim 11, wherein the first sleeve and first strap are contained in a single portion.

13. The garment of claim 11, wherein the second sleeve and second strap are contained in a single portion.

14. The garment of claim 12, wherein the second sleeve and second strap are contained in a single portion.

* * * * *